US005853106A

United States Patent [19]

Galluzzo

[11] Patent Number: 5,853,106

[45] Date of Patent: Dec. 29, 1998

[54] BEVERAGE ICE RETAINING APPARATUS

[76] Inventor: Mose A. Galluzzo, 4151 Tullock Woods Trail, Rockford, Ill. 61101

[21] Appl. No.: 993,761

[22] Filed: Dec. 18, 1997

[51] Int. Cl.[6] ..... A47G 19/22

[52] U.S. Cl. ..... 220/731; 220/703; 220/704

[58] Field of Search ..... 220/703, 704, 220/719, 731

[56] References Cited

U.S. PATENT DOCUMENTS

| | | | |
|---|---|---|---|
| D. 35,231 | 10/1901 | Snedeker | 220/704 X |
| 183,673 | 10/1876 | Horton | 220/704 |
| 442,698 | 12/1890 | Yates | 220/703 X |
| 600,152 | 3/1898 | Iams | 220/704 |
| 2,744,631 | 5/1956 | Toombs | 220/703 X |
| 3,150,084 | 9/1964 | Rodges | 220/703 X |
| 3,272,395 | 9/1966 | Lawyer | 220/731 X |
| 4,124,138 | 11/1978 | Saliba et al. | 220/704 |
| 5,702,024 | 12/1997 | Riso | 220/731 X |

*Primary Examiner*—Steven M. Pollard
*Attorney, Agent, or Firm*—Leydig, Voit & Mayer, Ltd.

[57] ABSTRACT

An ice retaining apparatus for use in a drinking vessel comprises a generally semi-circular surface which defines a plurality of orifices therethrough. The ice retaining apparatus includes retaining clips which are coupled to the semi-circular surface on either end of a diameter of that surface. Preferably, the retaining clips are coupled to the semi-circular surface in a fixed angular relationship defining an obtuse angle in relation thereto. The surface defines a slot therein which, due to the flexible nature of the surface, allows the slot to be widened and narrowed, thereby allowing the geometry of the surface to be varied. Additionally, to accommodate a users nose while drinking, the apparatus may include an aperture along the diameter of the semi-circular surface. The ice retaining apparatus is positioned within a drinking vessel by the retaining clips. The semi-circular surface then acts to block solid objects within a beverage while allowing the liquid to flow freely through. When positioned in the drinking vessel, the ice retaining apparatus generally conforms to the circular portion of the surface of the inner wall of the drinking vessel.

14 Claims, 6 Drawing Sheets

BEVERAGE ICE RETAINING APPARATUS

FIELD OF THE INVENTION

The instant application is directed to home and kitchen articles and more particularly to drinking aids.

BACKGROUND OF THE INVENTION

When people are thirsty, there is one thing which can consistently quench their thirst and make them more comfortable: an ice cold drink. Nothing can cool one off quicker or refresh one more fully than a favorite beverage chilled by the addition of a few cubes of ice.

Recognizing people's love of an ice cold drink, many home appliances manufacturers have set forth to design and market various types of ice makers for use in the home. Modern day refrigerators include ice makers in the freezer, or the even more convenient ice cubes through the door, in either crushed or cubed form. Nearly all grocery stores, gas stations, mini-marts, as well as many fast food restaurants also sale bagged party ice, allowing the pleasure of an ice cold drink to be shared by many at a party or other social event. In addition to natural ice, many home and kitchen stores also sell small plastic freezable ice cubes in various shapes and colors to add a festive look to party drinks, while cooling the drinks to that desirous ice cold temperature. The ice which is used to cool people's drinks comes in various sizes and shapes including cracked ice, small cubed ice, large cubed ice, half-moon shaped ice from an automatic ice maker, and small cylinders of ice from a party ice bag to name just a few.

However, while the use of ice in a drink certainly makes the drink colder and increases one's pleasure while drinking it, the actual pieces of ice often interfere with the drinking of the beverage, and actually detract from what otherwise would be a pleasurable experience. The ice cubes often float to the rim of the glass, blocking the smooth flow of beverage into one's mouth. The ice also detracts from one's pleasure when it hits the teeth, lips, or nose while the person is engaged in drinking the beverage. This problem is particularly acute for persons who wear dentures, plates, or other dental work which may be sensitive to direct contact with the ice cubes themselves. Additionally, the sudden shifting of the ice to the rim of the drinking vessel can cause spills as the drinking vessel is tipped to allow the person to drink from it.

These problems notwithstanding, people still desire to have ice in their beverages. In the past, attempts have been made to overcome the above mentioned problems through the use of various drinking aids. One such aid is the common plastic straw which is simply inserted into the glass and positioned near the bottom of the glass. Through the use of the straw the user is able to drink the beverage without having to tip the glass, thereby avoiding contact of the ice with the teeth, lips, and nose. This also eliminates the potential for spills caused by the shifting ice as the glass is tipped. However, the use of a straw is still hindered by the ice within a glass as the ice is drawn to the opening of the straw. The ice may then block the opening as the user attempts to drink from the straw. Additionally, the use of a straw often times reduces the pleasure which may be had by drinking certain beverages, requiring the user to draw the beverage up through the straw using a sucking motion. Also, the volume of fluid which is delivered into the mouth of a person is limited by the physical diameter of the straw, often requiring several sucks by the user to receive enough fluid to quench the thirst. Straws are also hard to clean or become expensive as they are replaced beverage after beverage.

Another attempt to solve the above problems, through the use of lids on the drinking containers, has also met with limited success. While the use of lids on drinking vessels has gained enormous popularity for the toddler segment of the market to prevent spills, the use of lids in the adult beverage market has not proved successful. One of the reasons for this lack of success is the difficulty of obtaining a leak-proof seal around the drinking container. In the toddler market, the container and lid are typically matched either with a screw-on type connection or a snap-lock type seal that allows the lid to make a leak-proof seal with the vessel. However, in the adult beverage market it is nearly impossible to provide a lid which can achieve a reliable leak-proof seal because of the shear variety and number of types and kinds of drinking vessels. Additionally, lids are hard to drink from, obstructing the natural lip of the drinking vessel, and often hit one's nose as he or she attempts to drink from the lidded vessel. While lidded containers have made great inroads in the sport drink market, their use and practicality in the home to resolve the above problems with ice in a beverage is limited at best.

In addition to the above-identified problems associated with having ice in one's beverage, the use of fruit or vegetables in one's beverage, while initially increasing one's pleasure of the beverage through enhanced flavor or visual impact, also can detract from ones pleasure in a similar way to ice. Additionally, the use of small pieces of fruit and vegetables, such as cherries or olives, may pose a health risk as the consumer may inadvertently swallow the articles by mistake. In the past, people have attempted to overcome this problem by placing the fruit or vegetables on a skewer prior to placing them in a drink. However, this method has met with limited success as the fruit or vegetables often fall off the skewer and are allowed to float freely in the drink.

SUMMARY OF THE INVENTION

In view of the foregoing, it is therefore an object of the instant invention to overcome these and other problems existing with the use of ice, fruit, vegetables, or other articles within a beverage. More particularly, it is an object of the instant invention to provide a means of retaining the ice or other articles within the beverage, without detracting from the pleasure received from drinking the beverage itself. It is a further object of the instant invention to provide a means for allowing a smoother flow of fluid from a drinking vessel which, in addition to the beverage itself, contains ice, fruit, vegetables, or other articles which are not meant to be consumed with the beverage. It is a further object of the instant invention to provide a means for retaining the articles within the beverage without interfering with the user's use of or contact with the drinking vessel. Specifically, it is an object of the instant invention to provide a means for retaining ice or other articles within a beverage without touching the user's face during the drinking process. It is an additional object of the instant invention to provide an ice or other article retaining means which does not regulate the volume of the beverage which the user is able to extract from the vessel during the drinking process. It is also an object of the instant invention to provide an ice or other article retaining means which does not draw undesired attention to the user. It is an additional object of the instant invention to provide an ice or other article retaining means for a beverage which visually enhances the beverage.

To accomplish the above and other objectives, a ice retaining apparatus is provided comprising a generally semi-circular surface which defines a plurality of orifices therethrough. The ice retaining apparatus includes retaining clips which are coupled to the semi-circular surface on either end of a diameter of that surface. Preferably, the retaining clips are coupled to the semi-circular surface in a fixed angular relationship, and more preferably defining an obtuse angle in relation thereto. In a preferred embodiment of the instant invention the ice retaining apparatus is not required to be perfectly geometrically semi-circular, but may define an approximately semi-circular surface having a width equal to a diameter of a semi-circle and a length which is equal to the hypotenuse of a right triangle which has as its base a side of length equal to one-half of the semi-circular diameter, and which includes an angle which is equal to the obtuse angle formed from the semi-circular surface to the retaining clips minus 90°. In a highly preferred embodiment of the instant invention, the surface defines a slot therein which, due to the flexible nature of the surface, allows the slot to be widened and narrowed, thereby allowing the geometry of the surface to be varied. Additionally, to accommodate a users nose while drinking, a preferred embodiment of the instant invention includes an aperture along the diameter of the semi-circular surface. This aperture may preferably be provided about the midpoint of the diameter of the semi-circular surface, and may run the length of the diameter of the semi-circular surface forming a concave edge along the surface.

In achieving the above objectives, a preferred embodiment of the instant invention is positioned within a drinking vessel by the retaining clips. The semi-circular surface then acts to block solid objects within a beverage while allowing the liquid to flow freely through the plurality of orifices defined therein. When positioned in the drinking vessel, a preferred embodiment of the instant invention generally conforms the circular portion of the surface to the inner wall of the drinking vessel.

These and other aims, objectives, advantages, and features of the invention will become apparent from the following detailed description while taken into conjunction with the accompanying drawings.

Figure 1:
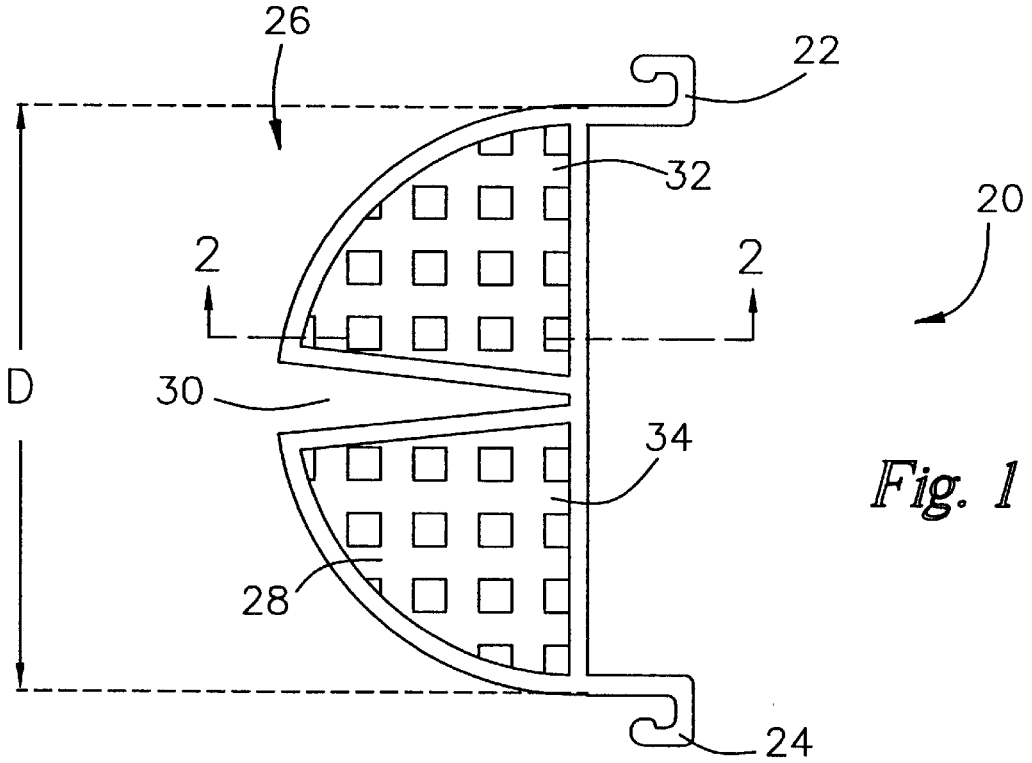
FIG. 1 is a top plainer view of an embodiment of the instant invention.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the invention is to cover all modifications, alternative constructions, and equivalents falling within the spirit and scope of the invention as defined by the appended claims.

DETAILED DESCRIPTION OF THE PREFERRED EMBODIMENTS

A preferred embodiment of the instant invention is illustrated in FIG. 1 in a top plainer view. As may be seen from this illustration, the ice retaining apparatus 20 of the instant invention comprises a generally semi-circular surface 26 which defines a plurality of orifices 28 therethrough. This surface 26 forms the retaining means for blocking solid objects which are included in a beverage, such as ice cubes, fruit, or vegetables. The ice retaining apparatus of the instant invention also includes retaining clips 22, 24 which are coupled to the semi-circular surface 26 on either end of a diameter D thereof. Also, as may be seen from FIG. 1, a preferred embodiment of the instant invention includes a slot 30 in the semi-circular surface 26. This slot separates and defines what may be considered to be two separate blocking sections 32, 34. With the slot 30 as illustrated in FIG. 1, the two blocking sections 32, 34 are allowed to flex in relation to one another to either widen or narrow the gap 30. This allows the geometry of the surface 26 to be varied to better allow general conformance of the surface 26 to the inner surface geometry of a drinking vessel. This widening and narrowing also allows the apparatus 20 to be used with drinking vessels of various diameters.

Figure 2:
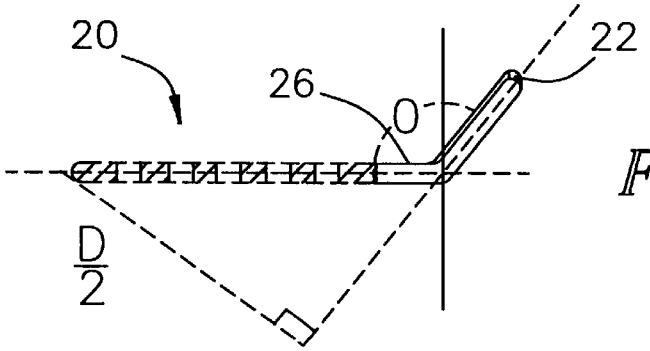
FIG. 2 is a side cross-sectional view of the embodiment of the instant invention illustrated in FIG. 1.

As becomes apparent with reference to FIG. 2, the retaining clips are fixably attached to the semi-circular surface 26 in a fixed angular relationship. In a preferred embodiment of the instant invention, the angular relationship between the retaining clips and the surface 26 is an obtuse angle, although other angular relationships are possible without deviating from the spirit and scope of the invention. The angular relationship is established to accommodate a user's lip during the consumption of the beverage. Without this angular relationship, the apparatus would be required to be positioned well within the drinking vessel to avoid unwanted contact with the user's lip. This also would reduce the amount of ice which one could place in the beverage. In a preferred embodiment of the instant invention, the angular relationship is set at approximately 120°. It will be understood that other angular relationships are appropriate and within the scope of the invention, including relationships defining right angles and acute angles.

As stated above, and as is apparent from FIG. 2, the semi-circular surface 26 need not be geometrically semi-circular in that as the angular relationship between the retaining clips and the surface 26 varies from 90°, the length of the semi-circular surface measured at a midpoint of the diameter D (see FIG. 1) varies. Specifically, the length of the surface 26 will be generally equal to a hypotenuse of a right triangle having a base which is equal to one-half of the diameter (see FIG. 1), and including an angle which is equal to the angle between the surface 26 and the clips minus 90°. Maintaining this relationship of the surface 26 length to the angular relationship of the clips to the surface allows the surface 26 to maintain general conformance to the side of the drinking vessel in which it is utilized. If the angular relationship between the surface 26 and clips is exactly 90°, the surface 26 may take the form of a perfectly geometrical semi-circle having a length equal to the radius, or one-half the diameter D (see FIG. 1).

Figure 3:
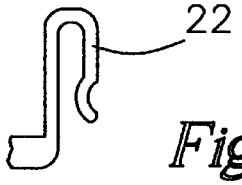
FIG. 3 is a partial view of an aspect of an embodiment of the instant invention illustrated in FIG. 1.

FIG. 3 illustrates a cross-sectional view of a retaining clip 22 used in a preferred embodiment of the instant invention. The retaining clips are shaped to accommodate the lip of a drinking vessel and serve as positioning means for securing the retaining surface within the drinking vessel. While not illustrated herein, the retaining clips may be coated with a rubberized material to prevent any chipping or scratching of the glass or other material from which the drinking vessel is constructed, if so desired. However, depending upon the material used to construct the clip, this coating may be unnecessary. It is also contemplated, although not illustrated, that the positioning means does not include the clip structure which is shaped to accommodate the lip of a drinking vessel. Instead, the positioning means would simply be straight, and would secure the retaining surface within the drinking vessel through friction with the inner wall of the vessel. As with the clips, this embodiment of the positioning means may be coated with a material to aid friction and reduce the possibility of scratching.

In a preferred embodiment of the instant invention, however, the clip is molded as a unitary assembly with the semi-circular surface 26 through an injection molding or other similar process. Preferably, an inert material is used to construct the ice retaining apparatus, which will not be affected by, nor react with, the various fluids which may be contained in the drinking vessel. This material should be flexible to allow the widening and narrowing of the slot 30 to generally accommodate various drinking vessel diameters, and is preferably a plastic or rubber-type material. Preferably, the material utilized is polypropylene or polyethylene, although other materials may be used as appropriate or desired. Upscale versions of an embodiment of the instant invention may be constructed out of gold, stainless steel, pewter, or other materials as are appropriate for drinking purposes.

Figure 4:
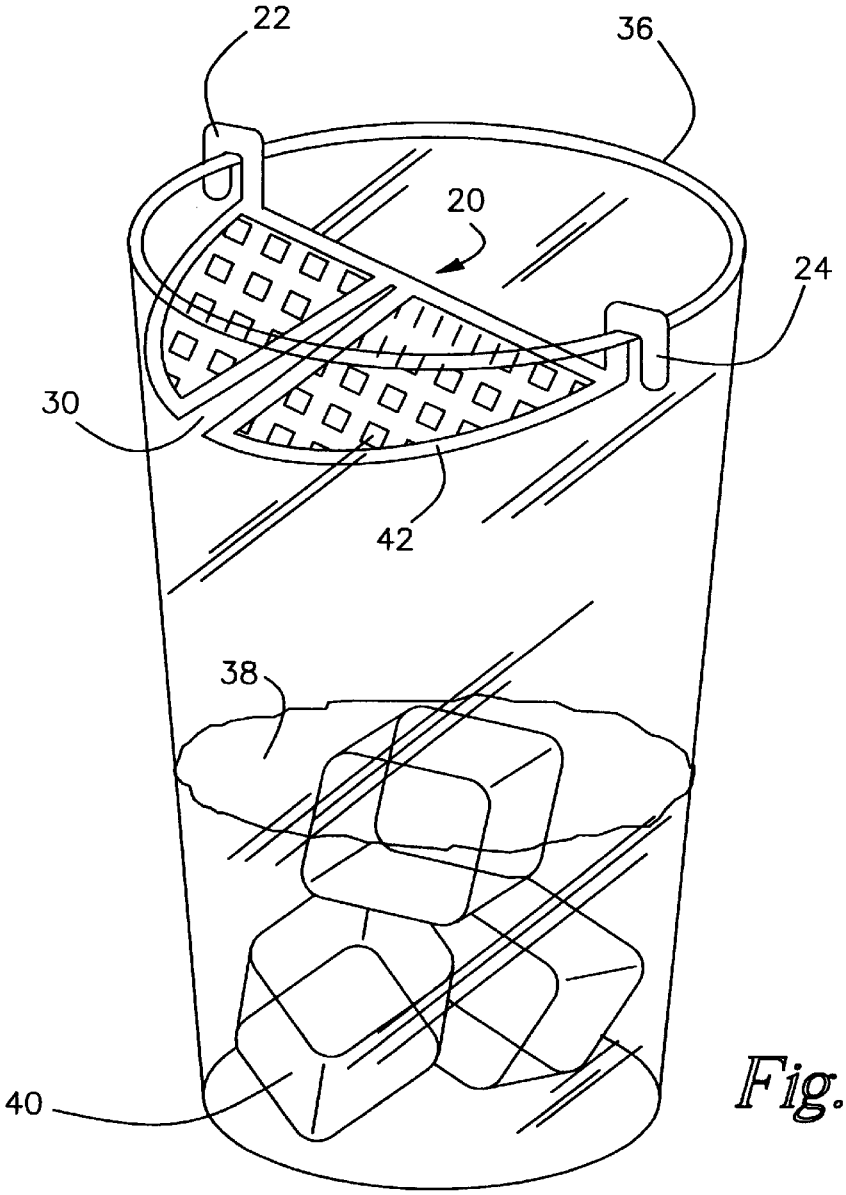
FIG. 4 is a perspective view illustrating an embodiment of the instant invention operating in its preferred environment.

FIG. 4 illustrates the installation of an embodiment of the instant invention in a drinking vessel 36. Also illustrated in the drinking vessel are the drinking fluid 38 and the objects to be retained while drinking, illustrated in this figure as ice cubes 40. The ice retaining apparatus 20 is positioned by clips 22, 24 within the drinking vessel 36. These clips 22, 24 serve to secure the ice retaining apparatus 20 within the drinking vessel 26. They also serve to position the apparatus 20 far enough within the drinking vessel so as to not interfere with a user's contact with the drinking vessel 36. The outer surface 42 of the apparatus 20, in conjunction with the slot 30 allows the apparatus 20 to generally conform to the geometry of a portion of the inner wall of the vessel by changing the geometry of the semi-circular surface 26. This widening and narrowing of the slot 30 also allows general conformance to drinking vessels of differing diameters.

Figure 5:
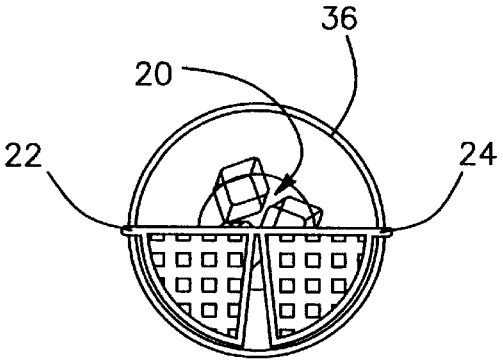
FIG. 5 is an overhead view of the installed embodiment of the instant invention illustrated in FIG. 4.
Figure 6:
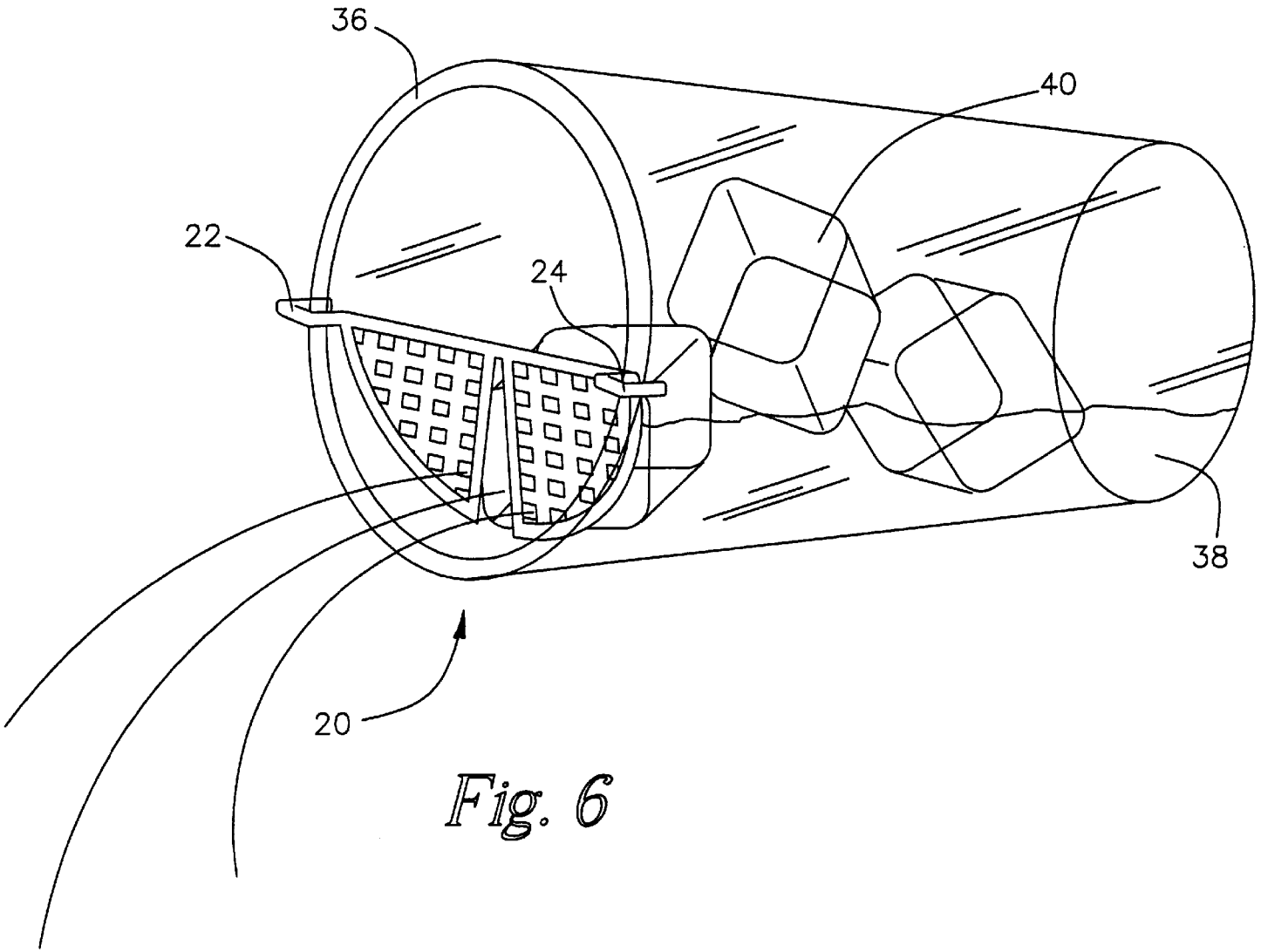
FIG. 6 is a side perspective view of the embodiment of the instant invention illustrated in FIG. 4 demonstrating the operation thereof.

FIG. 5 illustrates a top view of the drinking vessel 36 having the ice blocking apparatus 20 installed therein. While FIG. 5 may appear to illustrate a water tight seal between the outer surface 42 of the apparatus and the inner surface of the drinking vessel 36, no such water tight seal is required, although such a seal may result in particular installations. The lack of a water tight seal requirement allows the apparatus 20 to be fitted into drinking vessels 36 having various designs. As the drinking vessel is tilted to allow a user to consume the beverage 38, as is shown in FIG. 6, the ice 40 or other objects in the beverage, such as fruit or vegetables, are blocked by the apparatus 20 from contacting the users face. As may be seen from FIG. 6 however, the fluid 38 is allowed to flow through the orifices 28, the slot 30 (see FIG. 1), and possibly in-between the curved outer surface 42 and the inner surface of the drinking vessel, without significant obstruction. Since the apparatus 20 is positioned within the drinking vessel 36 at an angular relationship, the flow of fluid 38 is quite smooth by the time it reaches the lip of the vessel 36.

Figure 7:
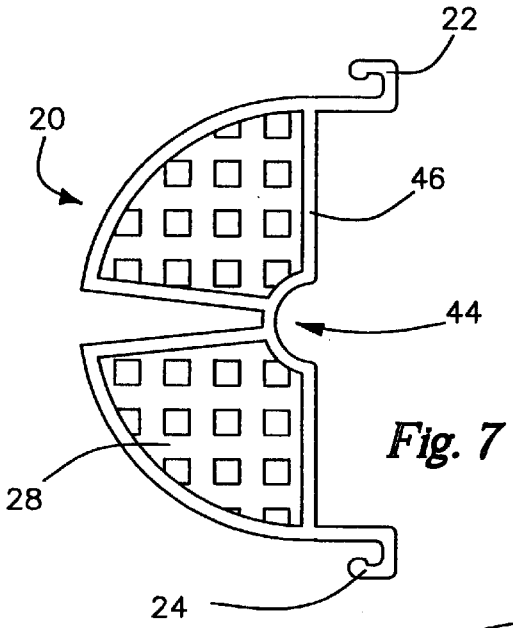
FIG. 7 is a top plainer view of an alternate embodiment of the instant invention.
Figure 8:
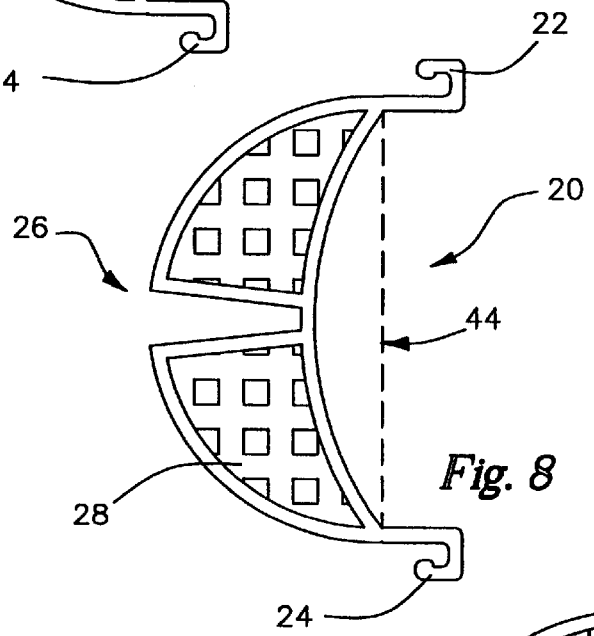
FIG. 8 is a top plainer view of an additional alternative embodiment of the instant invention.
Figure 9:
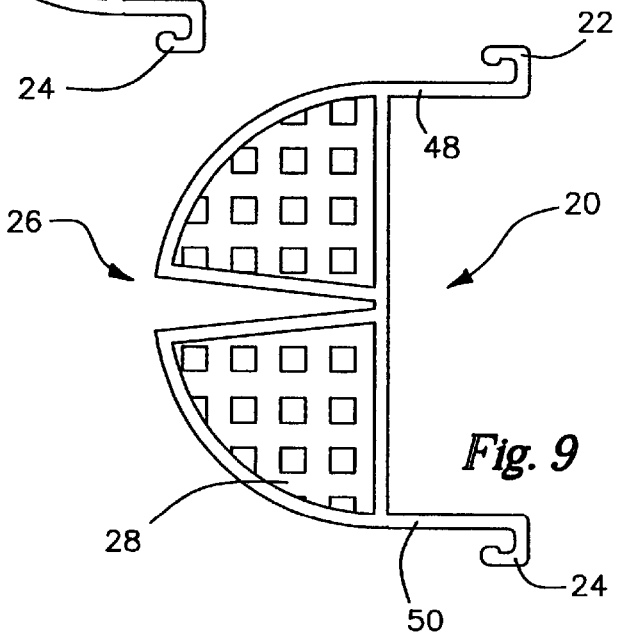
FIG. 9 is a top plainer view of a further additional alternative embodiment of the instant invention.

An alternate embodiment of the instant invention is illustrated in top planer view in FIG. 7. This embodiment of the instant invention includes an aperture 44 defined by the support member 46 along the diameter D of the apparatus 20. This aperture 44 serves as an accommodating means to reduce the likelihood of contact of the retaining apparatus 20 with a user's nose during the drinking process. As illustrated in FIG. 8, this aperture 44 may occupy the entire length of the diameter D forming a concave surface to accommodate a users nose. Alternatively, FIG. 9 illustrates an embodiment of the instant invention wherein extension members 48, 50 are included to allow the clips 22, 24 to position the apparatus 20 far enough within the drinking vessel 36 (see FIG. 4) such that the apparatus 20 does not contact the users face in any manner during the drinking process.

Figure 10:
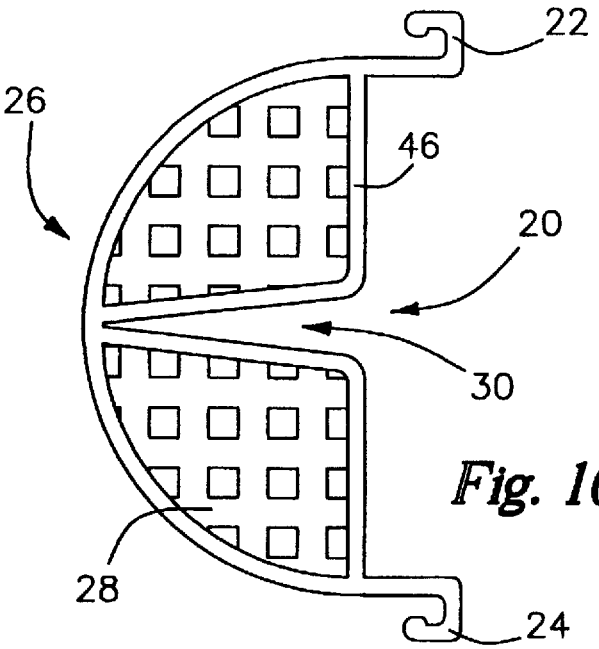
FIG. 10 is a top plainer view of a further additional alternative embodiment of the instant invention.

A highly preferred embodiment of the instant invention is illustrated in FIG. 10. In this embodiment the slot 30 opens along the support member 46 along the diameter of the surface 28, and is closed along the curved outer surface 42. Each of the blocking sections 32, 34 in this embodiment may be curved at the opening of the slot 30 to accommodate a user's nose, similar to the aperture 44 illustrated in FIG. 7. The curvature may be slight as illustrated in FIG. 10, or may larger forming an aperture 44' as illustrated in FIG. 14.

Figure 12:
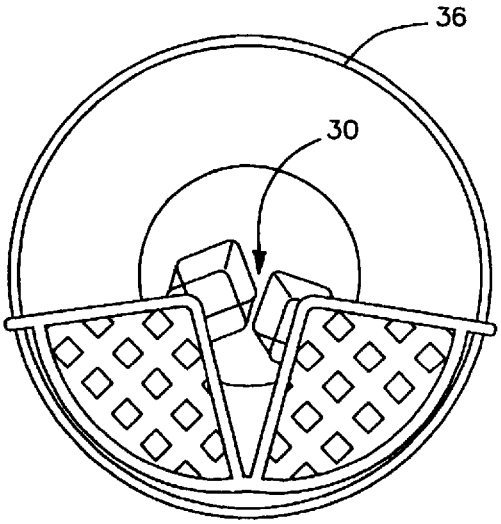
FIG. 12 is an overhead view of the installed embodiment of the instant invention illustrated in FIG. 10 in a drinking vessel having a larger diameter than the drinking vessel illustrated in FIG. 11.
Figure 13:
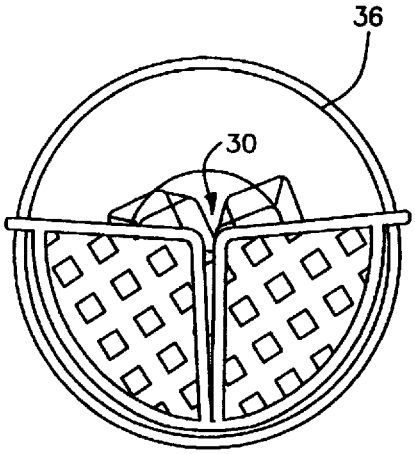
FIG. 13 is an overhead view of the installed embodiment of the instant invention illustrated in FIG. 10 in a drinking vessel having a smaller diameter than the drinking vessel illustrated in FIG. 11.

With reference again to FIG. 10, the slot 30 performs a similar function in this configuration, allowing a widening and a narrowing to alter the geometry of the surface 28, as in the embodiment illustrated in FIG. 1 and discussed above. This alteration of the geometry of surface 28 also repositions the clips 22, 24, allowing them to engage the lip of drinking vessels of widely varying diameters as illustrated in FIGS. 11–13.

Figure 11:
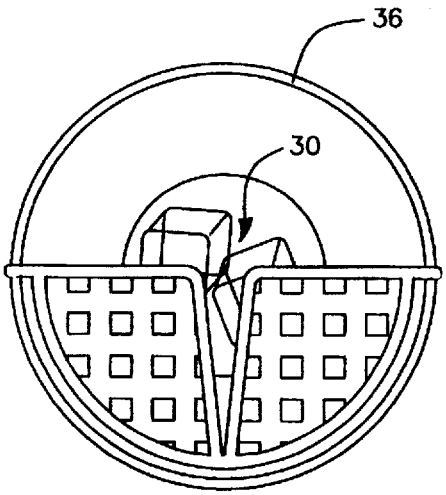
FIG. 11 is an overhead view of the installed embodiment of the instant invention illustrated in FIG. 10 in a drinking vessel.

With reference specifically to FIG. 11, the ice retaining apparatus 20 is positioned within a drinking vessel 36 having a diameter approximately equal to that of the apparatus 20. In this installation, the gap 30 is not required to be either widened or narrowed to any significant degree. However, as illustrated in FIG. 12, when the apparatus 20 is installed in a drinking vessel 36 having a diameter which is larger than that of the apparatus 20, the gap 30 is widened to accommodate the vessel 36. Likewise, when the apparatus 20 is installed in a drinking vessel having a diameter which is smaller than that of the apparatus 20, the gap 30 is narrowed to accommodate the vessel 36 as illustrated in FIG. 13. This feature of the invention greatly enhances its functionality, allowing for installation in a great variety of drinking vessels.

Figure 14:
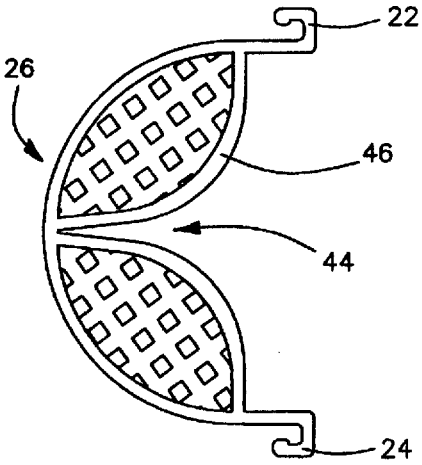
FIG. 14 is a top plainer view of a further additional alternative embodiment of the instant invention.

While not illustrated herein, the embodiments of the instant invention illustrated in FIGS. 10 and 14 may include the extension members 48, 50 as illustrated in FIG. 9 to position the apparatus 20 further within the drinking vessel as will be recognized by one skilled in the art. Illustration thereof is not included for the sake of brevity only.

Figure 15:
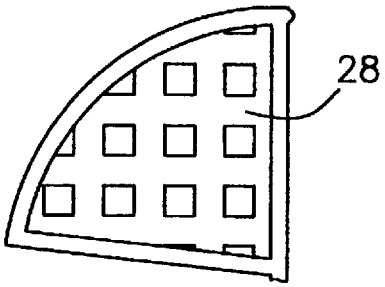
FIG. 15 is a partial cross-sectional view of an aspect of a preferred embodiment of the instant invention.
Figure 17:
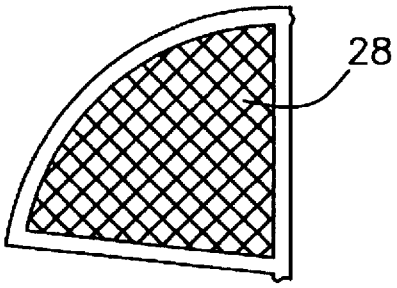
FIG. 17 is a partial cross-sectional view of an aspect of an additional alternative embodiment of the instant invention.
Figure 16:
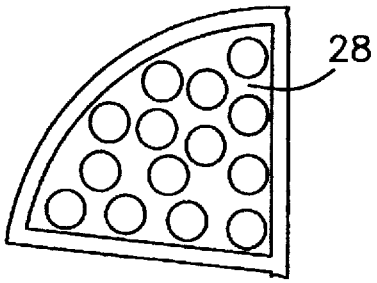
FIG. 16 is a partial cross-sectional view of an aspect of an alternative preferred embodiment of the instant invention.
Figure 18:
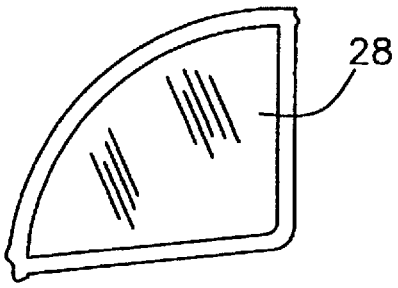
FIG. 18 is a partial cross-sectional view of an aspect of a further additional alternative embodiment of the instant invention.

The orifices included in the semi-circular surface 26 of the apparatus 20 may be of any shape as desired. Illustrative embodiments of various orifice designs are included in FIGS. 15–18. The orifices may be of various sizes, or may be uniform as desired. Preferably the minimum size of each of the orifices is approximately ¼" such that the objects retained during the drinking process do not include pulp or other matter which is intended to be drunk during the consumption of the beverage. Alternatively, as illustrated in FIG. 17, wire mesh or screening may be included to form the orifices to allow proper flow through of the drinking fluid 38. Also, based on the slot 30 and the lack of a requirement for a leak-proof seal between the curved outer surface 42 of the surface 28 and the inner surface of the drinking vessel, the orifices may be non-existent as illustrated by solid surface 28 of FIG. 18. However, for ease of manufacturing and economic considerations, a preferred embodiment of the instant invention includes the orifices 28 forming a grid-like structure as generally illustrated in FIG. 15.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure may be varied substantially without departing from the spirit of the invention, and exclusive use of all modifications that come within the scope of the appended claims is reserved.

What is claimed is:

1. An ice retaining apparatus for use in a drinking vessel containing a beverage and objects which are not intended to be consumed during the drinking of the beverage, the drinking vessel being generally cylindrical with a given diameter, a closed bottom, a curved inner surface, and a lip at the top from which a user drinks, the apparatus comprising:

a unitary structure defining a generally semi-circular surface having a continuous circumference and including first and second retaining clips integrally formed along said circumference and shaped to accommodate the lip of the drinking vessel along an entire length of said circumference; and wherein said generally semi-circular surface comprises first and second retaining surfaces flexibly joined at a point on said continuous circumference forming a slot extending therefrom to a diameter of said generally semi-circular surface, said first and second retaining surfaces positionable in a non-overlapping relationship with one another to allow said continuous circumference to generally conform to the curved inner surface of the drinking vessel, said slot widening or narrowing in response thereto; and wherein said first and second retaining surfaces define a plurality of orifices therein.

2. The retaining apparatus of claim 1, wherein said first and second retaining surfaces are generally wedged shaped, each of said first and second retaining surfaces having a first edge defining a continuous convex arc, and a second and third straight edge, and wherein said first and second retaining surfaces are integrally joined at an end of said arc such that said first and second retaining surfaces form said continuous circumference of said semi-circular surface.

3. The retaining apparatus of claim 2, wherein a length of said second and third edge of said first and second retaining surfaces is less than a length of a radius of said arc, said second and said third edge meeting at an obtuse angle thereby allowing narrowing of said slot to accommodate drinking vessels having diameters which are smaller than a diameter of said semicircular surface without overlap of said first and second retaining surfaces.

4. The retaining apparatus of claim 3, wherein said slot widens from said continuous circumference when said one of said straight surfaces from each of said first and second retaining surfaces lie along a diameter of said generally semi-circular surface.

5. The retaining apparatus of claim 1, wherein said first and second retaining surfaces define almond shaped surfaces having a first and a second convex curved edge, said first and second retaining surfaces are integrally joined at an end of said first curved edge such that said first and second retaining surfaces form said continuous circumference of said semi-circular surface.

6. The retaining apparatus of claim 5, wherein said slot defined between said second curved surface of said first and said second retaining surfaces accommodates a users nose while drinking regardless of drinking vessel diameter within which said retaining apparatus is positioned.

7. The retaining apparatus of claim 1, wherein said first and second retaining clips are integrally formed with said unitary structure in a angular relationship defining an obtuse angle from said semi-circular surface.

8. The retaining apparatus of claim 1, wherein said first and second retaining clips are integrally formed with said unitary structure and include extension members positioning said semi-circular surface to accommodate the nose of a user.

9. An ice retaining apparatus for use in a drinking vessel containing a beverage and objects which are not intended to be consumed during the drinking of the beverage, the drinking vessel being generally cylindrical with a given diameter, a closed bottom, a curved inner surface, and a lip at the top from which a user drinks, the apparatus comprising:

a unitary structure defining a generally semi-circular surface having a continuous diameter and including first and second retaining clips integrally formed at each end of said continuous diameter and shaped to accommodate the lip of the drinking vessel; and wherein said generally semi-circular surface comprises first and second retaining surfaces flexibly joined at a point on said continuous diameter forming a slot extending therefrom to a circumference of said generally semi-circular surface, said first and second retaining surfaces positionable in a non-overlapping relationship with one another to allow said circumference to generally conform to the curved inner surface of the drinking vessel, said slot widening or narrowing in response thereto; and wherein said first and second retaining surfaces define a plurality of orifices therein.

10. The retaining apparatus of claim 9, wherein said first and second retaining surfaces are generally wedged shaped, each of said first and second retaining surfaces having a first edge defining a continuous convex arc, and a second and third straight edge, and wherein said first and second retaining surfaces are integrally joined at an end of said straight edge such that said first and second retaining surfaces form said continuous diameter of said semi-circular surface.

11. The retaining apparatus of claim 10, wherein a length of said second and third edge of said first and second retaining surfaces is substantially equal to a length of a radius of said arc, said second and said third edge meeting at an acute angle thereby allowing narrowing of said slot to accommodate drinking vessels having diameters which are smaller than a diameter of said semicircular surface without overlap of said first and second retaining surfaces.

12. The retaining apparatus of claim 11, wherein said slot widens from said continuous diameter when said one of said straight surfaces from each of said first and second retaining surfaces lie along a diameter of said generally semi-circular surface.

13. The retaining apparatus of claim 9, wherein said first and second retaining clips are integrally formed with said unitary structure in a angular relationship defining an obtuse angle from said semi-circular surface.

14. The retaining apparatus of claim 9, wherein said first and second retaining clips are integrally formed with said unitary structure and include extension members positioning said semi-circular surface to accommodate the nose of a user.

* * * * *